US008561222B2

(12) United States Patent
Diarte

(10) Patent No.: US 8,561,222 B2
(45) Date of Patent: Oct. 22, 2013

(54) SWIMMING POOL COVER DEVICE

(76) Inventor: Marcelin Diarte, Ascarat (FR)

( * ) Notice: Subject to any disclaimer, the term of this patent is extended or adjusted under 35 U.S.C. 154(b) by 1130 days.

(21) Appl. No.: 11/724,226

(22) Filed: Mar. 15, 2007

(65) Prior Publication Data

US 2007/0220666 A1 Sep. 27, 2007

(30) Foreign Application Priority Data

Mar. 16, 2006 (FR) ..... 06 01793
Sep. 18, 2006 (FR) ..... 06 53786

(51) Int. Cl.
*E04H 4/00* (2006.01)

(52) U.S. Cl.
USPC ..... 4/498

(58) Field of Classification Search
USPC ..... 4/495, 498, 484, 504, 499, 500, 502, 4/580, 494; 126/171, 565, 566; 220/216; 52/3, 64; 193/37, 45; 296/100.03
See application file for complete search history.

(56) References Cited

U.S. PATENT DOCUMENTS

| | | | | |
|---|---|---|---|---|
| 2,848,722 | A * | 8/1958 | Choporis | 4/500 |
| 2,852,303 | A * | 9/1958 | Hopson | 296/26.09 |
| 4,681,371 | A * | 7/1987 | Leonard | 298/1 A |
| 5,303,527 | A * | 4/1994 | Perez et al. | 52/632 |
| 6,138,417 | A * | 10/2000 | Woodard et al. | 52/64 |
| 6,393,630 | B1 * | 5/2002 | Tedrick | 4/498 |
| 7,065,831 | B2 * | 6/2006 | Elmer | 16/91 |
| 7,412,733 | B2 * | 8/2008 | Dorsch | 4/498 |
| 2008/0016611 | A1 * | 1/2008 | Khalaf et al. | 4/498 |

FOREIGN PATENT DOCUMENTS

FR 2 752 002 2/1998

* cited by examiner

*Primary Examiner* — Lori Baker
(74) *Attorney, Agent, or Firm* — Young & Thompson

(57) ABSTRACT

A pool cover device includes at least one platform (1, 2) forming the terrace and displacement elements (110, 111, 210, 211, 15, 16, 17) for this platform so as to enable displacement of the platform on each side of a support area anchored in the ground along an edge of the swimming pool, the platform performing coverage of the swimming pool and also acting as a terrace regardless of its position.

1 Claim, 7 Drawing Sheets

SWIMMING POOL COVER DEVICE

BACKGROUND OF THE INVENTION

This invention relates to a swimming pool cover device.

DESCRIPTION OF THE RELATED ART

Various pool cover devices are available at the present time to prevent the water in the pool from pollution caused by foreign bodies for example such as plant materials (leaves, flower petals, branches), small animals (hedgehogs, toads, etc.), from falling into it.

Some swimming pool cover devices also provide protection for persons against drowning. These devices then satisfy standards in force. In France, standards NF 90-308 and NF 90-309 are applicable for shelter type cover devices, in other words veranda and/or lightweight structure, or safety cover type devices such as tarpaulins and/or roller shutters.

When the installed cover devices do not satisfy these standards, they must be used with peripheral detection safety devices or devices for the detection of a body falling into the pool.

Shelter type cover devices with a lightweight structure or veranda are large, and despite all efforts made by structure manufacturers, do not blend into the environment. But the major disadvantage is that such covers occupy space on the terrace built around the pool and correspondingly reduce the size of this terrace.

Tarpaulins or roller shutters are much more compact cover elements but are more difficult to put into place. When the roller shutter or the tarpaulins are on an external roller, this roller remains close to the edge of the pool and also reduces the available area of the terrace around the pool. When the roller shutter is inside the pool, it reduces the volume of the pool.

SUMMARY OF THE INVENTION

The purpose of this invention is to overcome the disadvantages of prior art.

In particular, this invention solves the problem caused by the space occupied within the area of terraces around pools and the reduction of these areas.

The purpose of this invention is a pool cover device that does not reduce the terrace around the pool, but on the contrary increases it, while providing protection functions for the water in the pool and for the protection of persons. The proposed cover device can also provide a thermal barrier.

To achieve this, the pool cover device is characterized principally in that it comprises at least a rigid deck and means of moving this deck, these means enabling displacement of the deck on each side of a support area fixed along one edge of the pool so as to cover or uncover the pool, the deck thus acting as a cover for the pool, and also as a terrace regardless of its position.

The deck comprises a frame covered with a floor, giving it the strength of a terrace including when it is in cantilevered, in other words in the pool covered position.

To enable movement of the deck on each side of the support area without occupying space or being inconvenient for users, the displacement means comprise at least two rows of rollers arranged along the deck displacement direction in the support area and at least two lateral rails placed under the deck along its edges so that it can move along the rows of rollers. The deck can thus move on rails that cannot be seen and that do not inconvenience pool users.

The rails are formed by two side arms forming the frame, to simplify the construction.

To improve guidance, the displacement means include a third row of rollers arranged between the two side rows, and a third rail placed between the two side rails.

The rows of rollers are fixed to the ground through a plate fixed to buried concrete pads, their location in the ground defining the load bearing area of the deck.

In the case of a square or rectangular pool, the device comprises two decks each of which moves on each side of its support area, so as to cover the entire pool.

Depending on the configuration of the pool or the ground around the pool, the decks may be arranged along the opposite or adjacent edges of the pool.

BRIEF DESCRIPTION OF THE DRAWINGS

Other special features and advantages of the invention will become clear after reading the description given below as an illustration and that is in no way limitative, with reference to the figures in which.

DESCRIPTION OF THE PREFERRED EMBODIMENTS

The pool cover device according to the invention does not reduce the area of terraces around pools, but on the contrary can increase it. Apart from the functions of protecting the water and keeping it warm, it also performs the safety function defined by standards in force, thus providing protection for persons and particularly young children.

To achieve this, the proposed pool cover device includes at least one rigid deck 1.

In the examples given below in FIGS. 2 to 7 and 9, the protection device includes two decks that completely close off the pool when they are moved above the pool.

With the device according to the invention, the decks can be cantilevered above the pool and it can be understood that two or more decks can be used to cover long pools or pools with non-rectangular shapes.

Figure 8:
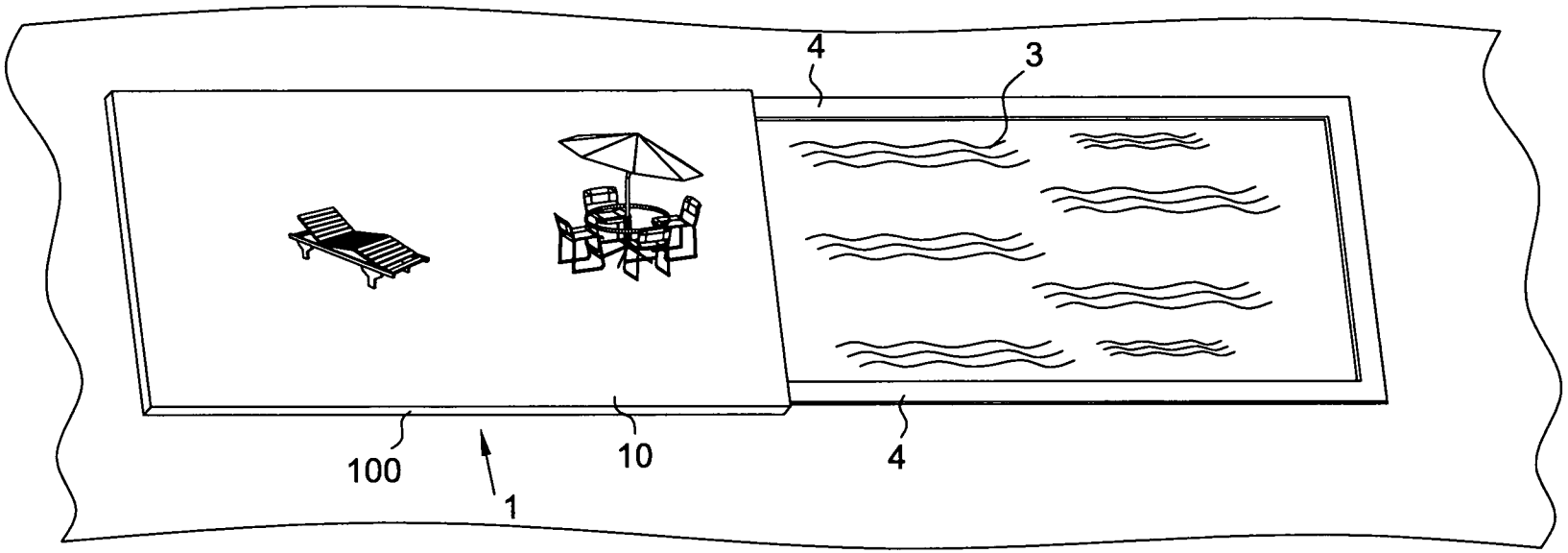
FIGS. 8 and 9 show two other embodiments of the invention.

Obviously, a single deck may be used to perform this cover function as illustrated on the diagram in FIG. 8 whenever possible, depending on the size of the pool, in other words for small pools.

Each deck 1, 2 forms a rigid platform that can be moved on each part of a support area on the ground F1-F2 arranged along one edge of the pool so that each deck moves in simple translation and is held cantilevered above the pool, closing off the planned part.

Each deck 1, 2 comprises a rigid frame 100, 200 (FIG. 7), holding it cantilevered and with the same load bearing capacity as a conventional terrace. This frame 100, 200 is covered by a floor 10, 20 so that the assembly can act as a terrace. The terrace function is performed by the two decks regardless of their position, in other words whether or not they cover the pool as can be seen in the figures.

In practice, the dimensions of the deck(s) are chosen so that they do completely cover the pool 3. The deck width is equal to the effective pool width, in other words the width of the water surface and the sundeck 4.

Figure 1:
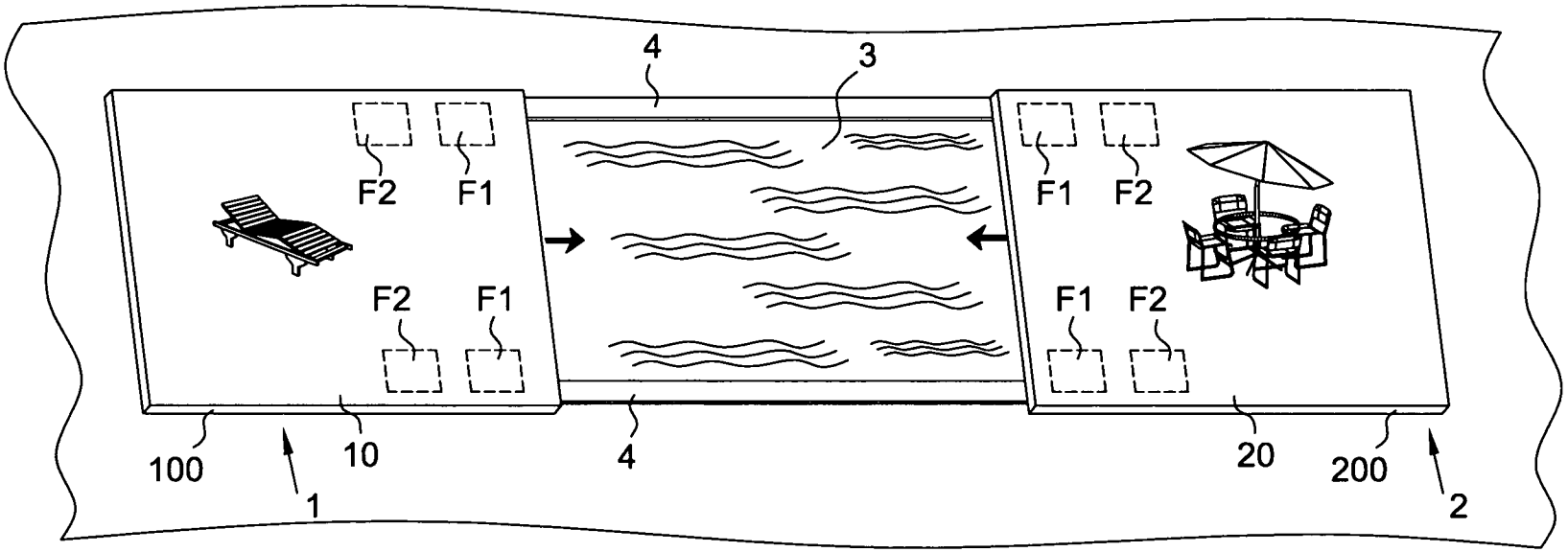
FIG. 1 shows a perspective diagram of the device according to the invention in a first embodiment with the pool uncovered.
Figure 2:
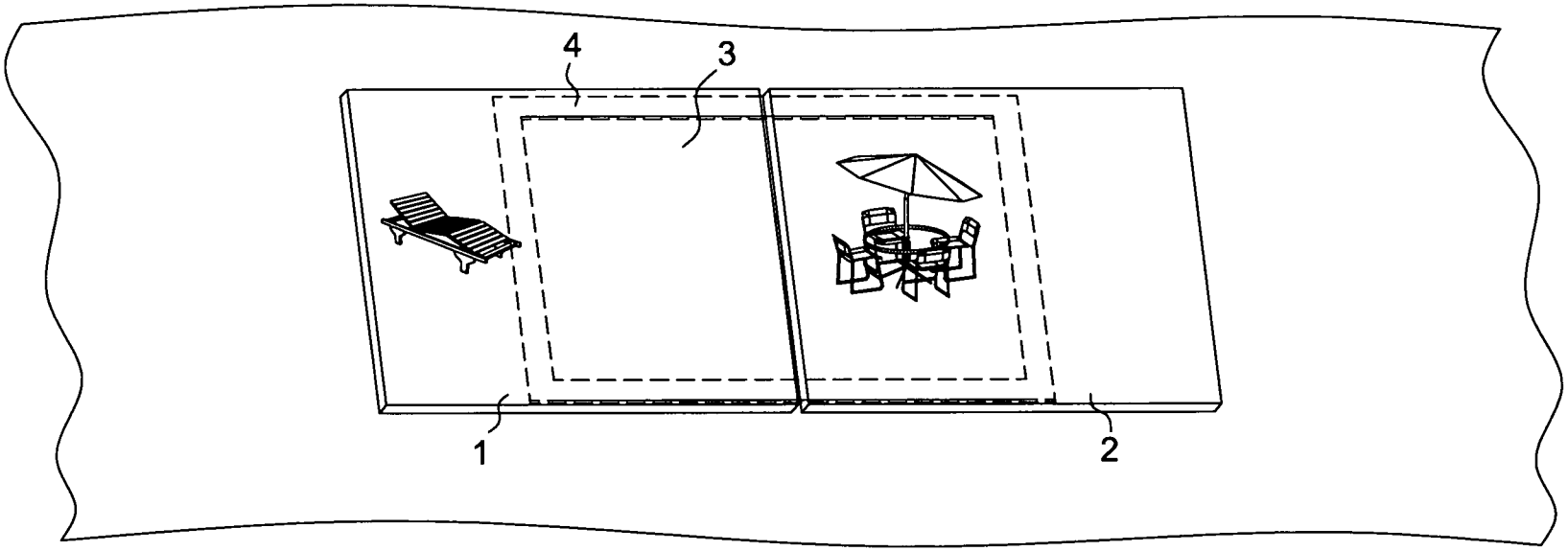
FIG. 2 shows a perspective diagram of the device according to the invention in a first embodiment with the pool covered.

The displacement system is shown in detail in FIGS. 3, 4, 5 and 6, but this system cannot be seen from above the decks shown in FIGS. 1 and 2. The system is located underneath the decks and consequently is in no way an inconvenience for users.

As mentioned above, the deck displacement system enables movement of the decks on each side of the deck support area on the ground F1-F2. The decks are moved in translation along the direction of the arrows to close them.

In the example embodiments given, the system comprises firstly rails fixed under the deck and secondly a set of rollers fixed to the ground on which the rails can slide.

In practice, the deck displacement system comprises an assembly for example including three rows R1, R2, R3 of rollers 110, 111 (210-220) fixed to the ground.

On the examples in FIGS. 1 to 7, the three rows R1, R2, R3 are arranged in an area along one edge of the pool and close to it. This area defines the support area F1-F2 of the deck. The system also comprises rails 15, 16, 17 and 25, 26, 27 formed by frame elements 100, 200.

Rollers 110 and 111 are mounted and fixed on the plates 150, themselves fixed on each side of the pool on concrete pads 12, 13, and 21, 22, by anchorage of anchor rods 130 or chemical anchors. The concrete wall around the pool can be used as a support F1.

For a new pool construction, pads (support points) F1 and F2 are connected through a longitudinal beam fixed to the pool wall.

Rails 15, 16, 17 are used for displacement of the deck and also form the main frame elements on which the floor is fitted. This is why the original off-the-shelf rails will be reinforced depending on the size of the pool and the spans of this frame.

Figure 3:
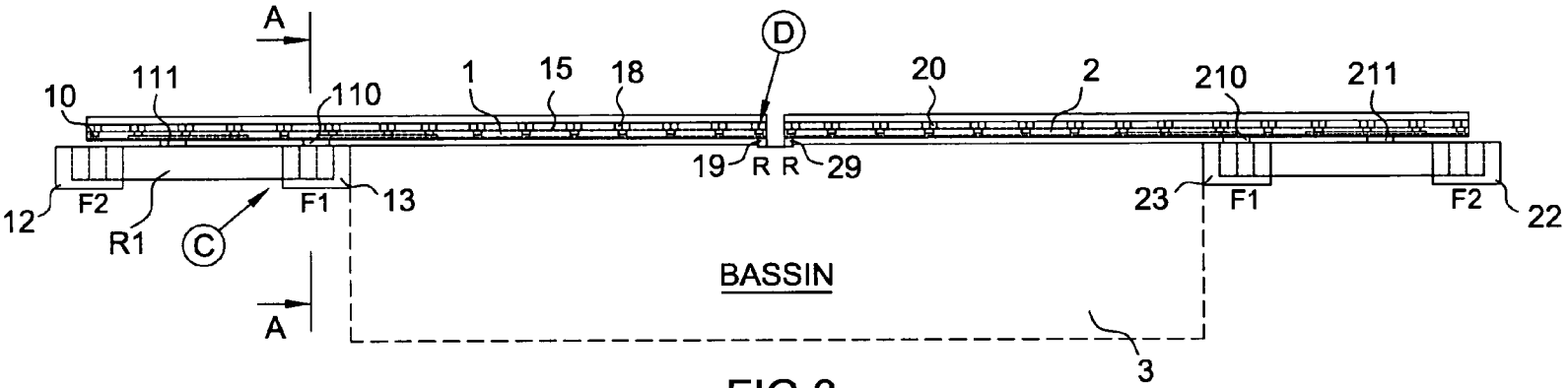
FIG. 3 shows a longitudinal sectional diagram of the device shown in FIGS. 1 and 2.
Figure 5:
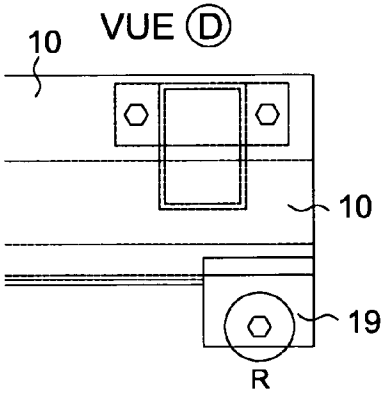
FIG. 5 shows a longitudinal sectional diagram of the front end D of the cantilevered deck.
Figure 4:
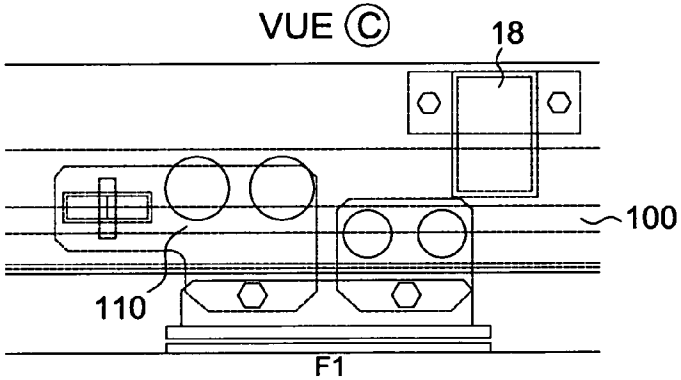
FIG. 4 shows a detailed longitudinal sectional diagram of a part C of the displacement system in the support area.
Figure 6:
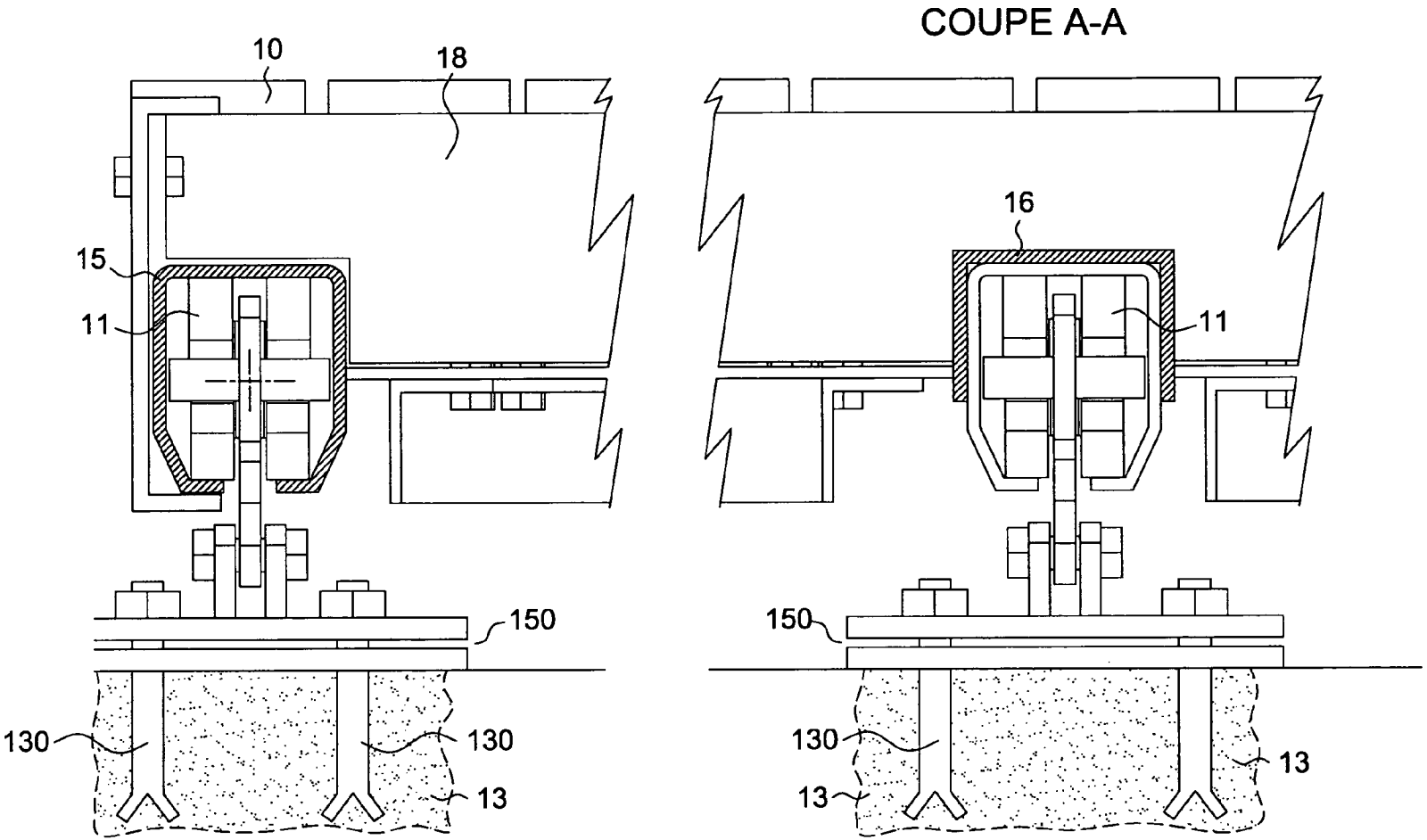
FIG. 6 shows a cross-sectional diagram A-A of the displacement system on a support area F1 of the deck.

For long decks (more than 4 m), the rails on the "cantilever" side, in other words along the edge D as illustrated in FIGS. 3 and 5, are advantageously provided with a wheel 19 on each side edge of the pool supported on the sundeck 4 of said pool. In this case, the wheels form additional support points to prevent deflection of the deck, which is no longer cantilevered in this case.

The support rails 15, 16, 17; 25, 26, 27 are connected to each other by a bolting system, through rectangular cross-section tubes 18, also designed as a function of the deck dimensions.

Said floor that may be made of wood such as TEAK, or a metal or resin grating, is screwed onto the tubes 18 acting as a support for the floor 10. The tubes 18 are preferably braced by tubes 19 preferably in the support area and possibly along the entire length to prevent deformations, as can be seen on the diagram in FIG. 7.

Figure 9:
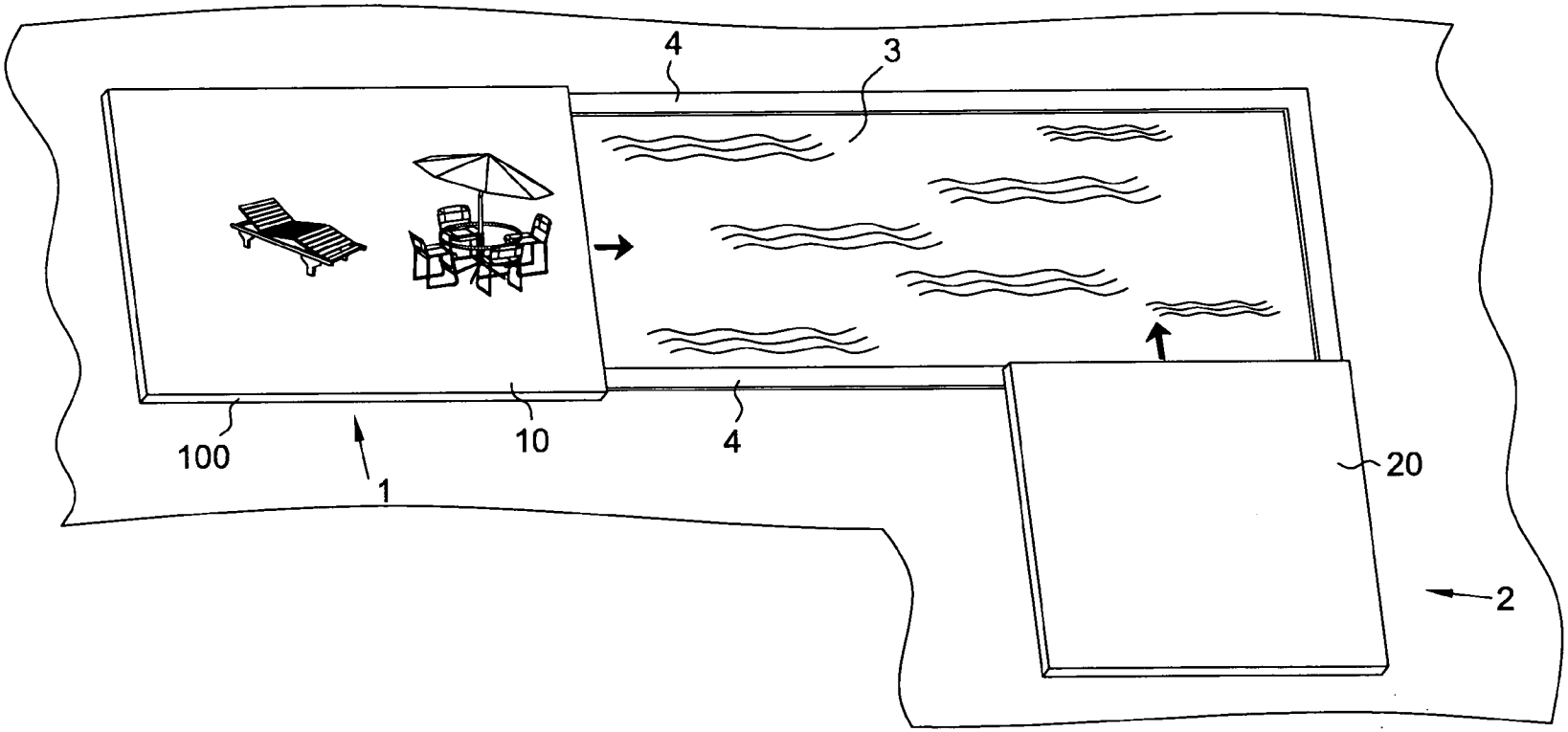

FIGS. 8 and 9 diagrammatically show two other embodiments of the device. FIG. 8 shows a device with a single deck 1. FIG. 9 shows a device with two orthogonal decks 1, 2 which can move along perpendicular axes.

The pool 3 is opened and closed effortlessly, either by pushing manually, or electrically. For safety, a mechanical locking (insert) or electrical locking (remote control) system may be provided to prevent displacement of the deck in the pool closed position. Otherwise, an alarm type device may be associated with the closing device.

The embodiment of the device will be chosen as a function of the dimensions of the pool to be protected and the choice of off-the-shelf materials.

The cover device that has just been described performs water protection and safety functions and is in no way inconvenient for users, because not only does it not reduce the size of the terrace, it actually increases it.

This device has a practical and aesthetic advantage because it is in the form of a "terrace" platform without any other visible or large element, or any element that could cause injury. All elements of the displacement system are under the deck forming this platform, both when the pool is covered by the deck and when it is exposed.

The cover device of the invention thus has at least one rigid deck (1), FIG. 1. The displacement means (110, 111; 15, 16, 17) for the deck includes at least two side rails (15, 17) fixed under the deck along edges of the deck, and at least two side rows (R1, R2, R3) of rollers (110, 111, 210-220), shown in FIG. 7. FIG. 3 shows the side rows of rollers (110, 111) fixed to a ground area along the left edge of the pool projecting out from the left edge of the pool (the ground area defining a fixed deck support area F1-F2 along the left side of the pool). FIG. 3 also shows that each side row of rollers comprises at least two spaced apart rollers (110, 111).

The displacement means enables displacement of the deck on each side of the support area so as to cover or uncover the pool to provide a fully open position and a fully closed position. Compare FIG. 1 to FIG. 2.

Figure 7:
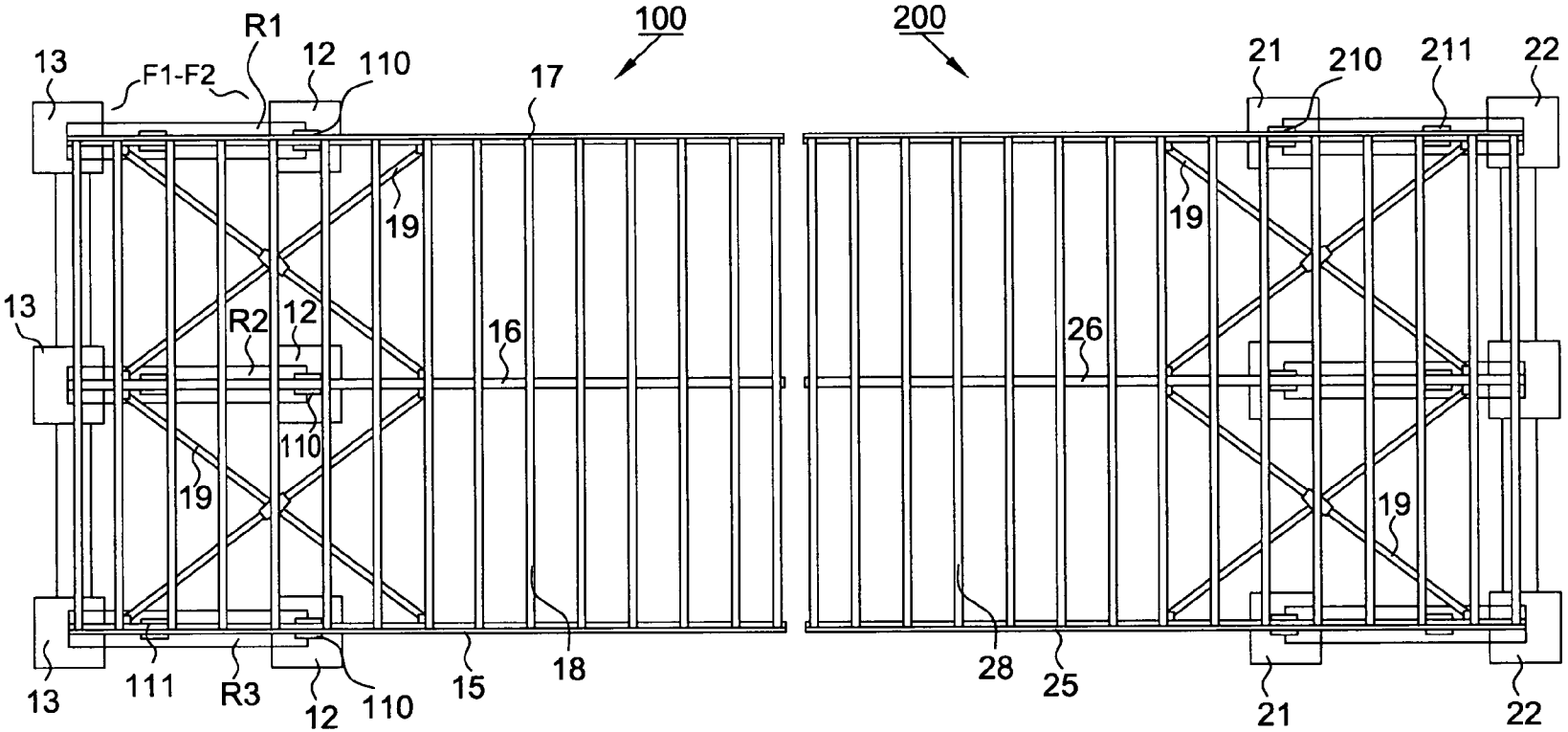
FIG. 7 shows a diagram of the deck support frame including the rails.

In the fully open position, a first end of the deck is supported by the rows of rollers and a remaining portion of the deck extends unsupported beyond the rows of rollers, and in a fully closed position, an opposite, second end of the deck rests on and is supported by the rows of rollers with another remaining portion of the deck covering the pool. This can be understood by comparing FIGS. 1-2 with the details of FIGS. 3 and 7. In the fully closed position, the leftmost end of the deck rests on the rollers and the remaining right-hand portion of the deck covers the pool. In the fully closed position, the leftmost portion of the deck is supported by the rollers and the remaining left-hand portion of the deck covers the pool. In either the fully open or the full closed position, the supported portion of the deck is a smaller portion of the deck as compared to the unsupported portion of the deck. FIG. 1 shows two rows whereas FIG. 7 shows three rows of rollers.

The invention claimed is:

1. A pool cover device for covering a pool, comprising:

a rigid deck (1) cantileverable above the pool in a closed position;

a ground support arranged along one edge of the pool and defining a ground support area along the one edge of the pool, the deck forming a rigid platform moveable over the ground support area so that each deck is moveable in translation and is held cantilevered above the pool, wherein, the deck comprises a rigid frame, a floor covering the frame; and a displacement system located underneath the deck, the deck displacement system enabling movement of the deck in translation, the displacement system comprising three rails fixed under the deck and a set of three rows of rollers fixed, via the ground support, to the ground, the rollers slideable on the rails, in a fully open position, a first end of the deck rests on and is supported by the three rows of rollers, a remaining portion of the deck extends unsupported beyond the rows of rollers, a length of the unsupported remaining portion is greater than the length of the first end of the deck supported by the rollers, and in a fully closed position, an opposite, second end of the deck rests on and is supported by the three rows of rollers with another remaining portion of the deck covering the pool and held cantilevered over the pool, a length of the another remaining portion covering the pool is greater than the length of the second end of the deck supported by the rollers, the remaining portion of the deck held cantilevered over the pool being unsupported by any rollers located over the pool.

* * * * *